US012472423B2

(12) United States Patent
Thaler

(10) Patent No.: US 12,472,423 B2
(45) Date of Patent: Nov. 18, 2025

(54) DEVICE AND METHOD FOR TREATING A RUNNING-SURFACE COATING OF A PIECE OF WINTER SPORTS EQUIPMENT

(71) Applicant: Hermann Thaler, Schruns (AT)

(72) Inventor: Hermann Thaler, Schruns (AT)

( * ) Notice: Subject to any disclaimer, the term of this patent is extended or adjusted under 35 U.S.C. 154(b) by 0 days.

(21) Appl. No.: 18/543,582

(22) Filed: Dec. 18, 2023

(65) Prior Publication Data

US 2024/0115925 A1 Apr. 11, 2024

Related U.S. Application Data

(63) Continuation of application No. PCT/AT2022/060204, filed on Jun. 20, 2022.

(30) Foreign Application Priority Data

Jun. 23, 2021 (AT) ..... A 50515/2021

(51) Int. Cl.
*A63C 11/08* (2006.01)

(52) U.S. Cl.
CPC ..... *A63C 11/08* (2013.01)

(58) Field of Classification Search
CPC ..... A63C 11/08
USPC ..... 401/1
See application file for complete search history.

(56) References Cited

U.S. PATENT DOCUMENTS

| | | | | |
|---|---|---|---|---|
| 3,425,394 A | | 2/1969 | Rey | |
| 3,464,381 A | | 9/1969 | Rey | |
| 4,577,586 A | * | 3/1986 | Morris | A63C 11/08 118/100 |
| 4,899,692 A | * | 2/1990 | Suzuki | A63C 11/08 118/100 |
| 5,202,041 A | * | 4/1993 | Traverso | A63C 11/08 280/610 |
| 5,209,780 A | | 5/1993 | Partel | |
| 2007/0272145 A1 | | 11/2007 | Aunola | |

FOREIGN PATENT DOCUMENTS

| | | |
|---|---|---|
| AT | 397 925 | 8/1994 |
| DE | 1 478 167 | 3/1970 |
| DE | 1 578 879 | 10/1971 |
| DE | 32 37 753 | 4/1984 |
| DE | 38 33 103 | 4/1990 |

OTHER PUBLICATIONS

International Search Report issued Sep. 20, 2022 in International (PCT) Application No. PCT/AT2022/060204.

* cited by examiner

*Primary Examiner* — David P Angwin
*Assistant Examiner* — Bradley S Oliver
(74) *Attorney, Agent, or Firm* — Wenderoth, Lind & Ponack, L.L.P.

(57) ABSTRACT

A device is for treating a running-surface coating of a piece of winter sports equipment. The device includes a movement device for generating a relative movement between the device and the running-surface coating of the piece of winter sports equipment, an application device for applying a ski wax to the running-surface coating of the piece of winter sports equipment, a heating device for heating the ski wax applied to the running-surface coating of the piece of winter sports equipment to above a melting temperature of the ski wax, and a cooling device for actively cooling the ski wax melted by the heating device to below a solidification temperature of the ski wax.

20 Claims, 3 Drawing Sheets

DEVICE AND METHOD FOR TREATING A RUNNING-SURFACE COATING OF A PIECE OF WINTER SPORTS EQUIPMENT

BACKGROUND OF THE INVENTION

The present invention relates to a device for treating a running-surface coating of a piece of winter sports equipment and a method for treating a running-surface coating of a piece of winter sports equipment.

Winter sports equipment can be for example skis, snowboards or other means of transport which have a running-surface coating in order to slide on a ground. The state of the art is to be outlined hereinafter by reference to the example of a ski. This applies analogously to winter sports equipment in general.

It is generally known from the state of the art to treat winter sports equipment, in particular skis or snowboards with a ski wax on their running-surface coating.

A ski wax is a wax which is applied to a running-surface coating of a ski. This ski wax reduces the friction between the running-surface coating and for example a snowy ground through the water-repellent effect on the running-surface coating.

This water-repellent effect of the wax is used since, due to the pressure of the ski on the ground, preferably the snow, or generally due to wet snow, the ski slides mostly on water, wherein, by applying a wax to the running-surface coating of the ski, the friction can be significantly reduced and thus the sliding capability of the ski (and also the speeds and accelerations to be achieved) can be significantly increased.

It is known to arrange the ski wax on the running-surface coating on the skis in liquid, melted form or powder form and then to melt it on through the action of heat.

It is also known to rub the ski wax on the running-surface coating in solid form (usually block form), so that the wax attaches to the running-surface coating (in a way rubs off from the block), wherein in turn the ski wax on the running-surface coating is then heated through an action of external heat.

Through the heating or liquid application of the ski wax onto the running-surface coating, the ski wax soaks into the pores, openings, indentations or scratches of the running-surface coating, whereby the ski wax is held on the running-surface coating.

After heating, a specific time is waited, with the result that the ski wax in turn passes into a solid state (in a way hardened), wherein the superfluous ski wax can then still be removed, for example by a scraper, whereby the process of waxing the ski is completed.

This is generally carried out during a service of a ski, wherein, due to the increasing popularity of winter sports, there is an ever greater number of pieces of winter sports equipment for treatment at service stations, whereby it is also becoming increasingly important to achieve as high as possible throughputs in order to be able to manage the quantity of pieces of winter sports equipment and increase efficiency.

SUMMARY OF THE INVENTION

The object of the present invention is therefore to provide a device for treating a running-surface coating of a piece of winter sports equipment and a method for treating a running-surface coating of a piece of winter sports equipment, with the aid of which a resource-saving treatment and/or more efficient treatment and/or quicker treatment and/or longer cycle time of the treatment can be achieved.

This object is achieved by a device for treating a running-surface coating of a piece of winter sports equipment as described below, and a method for treating a running-surface coating of a piece of winter sports equipment with the features described below.

According to the invention, the device for treating a running-surface coating of a piece of winter sports equipment comprises:

- at least one movement device for generating a relative movement between the device and the running-surface coating of the piece of winter sports equipment,
- at least one application device for applying a ski wax to the running-surface coating of the piece of winter sports equipment,
- at least one heating device for heating the ski wax applied to the running-surface coating of the piece of winter sports equipment to above the melting temperature of the ski wax, and
- at least one cooling device for actively cooling the ski wax melted by the heating device to below the solidification temperature of the ski wax.

Through the provision of at least one cooling device, which is formed to actively cool the ski wax melted by the heating device, a solidification of the ski wax can be achieved in less time, whereby a subsequent stripping process can take place earlier. It is therefore no longer necessary to accept longer cooling times, whereby the treatment time of the running-surface coating can be tremendously lowered.

Through this immense shortening of the treatment time of the running-surface coating, a higher number of cycles can be achieved or a higher number of pieces of winter sports equipment can be treated in the same time, which increases efficiency, speed and also productivity.

An active cooling is to be understood in the course of the present document as a cooling with a higher cooling efficiency than a pure heat dissipation to the surroundings.

By an active cooling is therefore meant, in the course of the present document, that heat is actively delivered by a cooling device, which exceeds the pure cooling due to environmental conditions (for example due to the room temperature and air in the room).

Heat can therefore be extracted from the ski wax heated by the at least one heating device very quickly in order to lower the treatment time of the piece of winter sports equipment.

Pieces of winter sports equipment can preferably be skis, snowboards or the like. Any other embodiment of a piece of winter sports equipment with a running-surface coating, which serves for sliding on a ground, preferably snow, is also entirely conceivable and can be treated using a method according to the invention or a device according to the invention.

By the melting temperature of the ski wax can be meant a temperature or a temperature range above which the ski wax passes from a solid into a liquid state of matter.

By the solidification temperature of the ski wax can be meant a temperature or a temperature range below which the ski wax passes from a liquid into a solid state of matter.

Preferably, the at least one cooling device has at least one cool air blower, wherein a gaseous fluid—preferably air—can be blown for cooling the ski wax melted by the heating device.

The cool air blower can have a cooling apparatus which lowers the temperature of the conveyed fluid.

A ski wax heated by the at least one heating device can thus be actively cooled by a cool air blower through convective airflow.

The cool air blower can, for example, draw in ambient air and release it into the desired area for cooling, whereby an increased heat dissipation can be carried out through the increased flow and the conveyed air.

This can of course therefore be promoted by cooling the ambient air, drawn in for example by the cooling device, using the cool air blower and then releasing it into an area for cooling.

Preferably, the at least one cooling device has a cooled section, which can be brought into contact with the piece of winter sports equipment, preferably with the upper side opposite the running-surface coating.

Thus, an upper side of the piece of winter sports equipment (here reference may be made for example to a ski) can, for example, be placed on a cold item (such as for example a cold metal plate or an ice block). Thus, the running-surface coating and thus the ski wax heated thereon by the at least one heating device can be actively cooled through the piece of winter sports equipment.

However, embodiments are also conceivable in which, for example, the upper side or the entire piece of winter sports equipment is guided through a water bath or ice bath and thus cooled.

At least one stripping device can be provided, preferably a brush and/or a polishing station, wherein excess solidified ski wax can be removed from the running-surface coating of the piece of winter sports equipment by the at least one stripping device.

Furthermore, after solidification, the wax can be acted upon by a structure through the at least one stripping device or is taken off from the running-surface coating to such an extent that the wax extends with a constant cross section over the entire running-surface coating, whereby the wax, with its upper surface, can also adopt for example an "uneven" shape of the running-surface coating.

Preferably, the at least one heating device has at least two heating stations.

The at least one heating device has at least one hot air blower, IR heater and/or ironing device.

For example, the heating device is formed as a contactless heating device, wherein a ski wax and/or a running-surface coating can be heated contactlessly via the at least one heating device.

A blower is preferably provided which is formed to operate selectively as at least one heating device and at least one cooling device, by the temperature of the released gaseous fluid, preferably air, being adjustable.

Accordingly, one and the same blower can function as heating device and as cooling device, wherein for example in a first step the blower can be guided over the running-surface coating as a heating device with increased temperature, in order melt a ski wax. The temperature of the blower can then be lowered, whereby the blower serves as a cooling device and can be guided over the running-surface coating again, in order to cool the previously melted ski wax to below the solidification temperature.

The ski wax can be applied by the at least one application device in a powder or liquid state.

Preferably, the ski wax comprises a hydrocarbon wax and/or a fluoro wax. However, all other embodiments of a ski wax which are known through the state of the art are also entirely conceivable.

Preferably, the at least one movement device has a controlled or regulated infeed device.

This controlled or regulated infeed device can be formed to generate a relative movement between device and piece of winter sports equipment via a drive unit, by for example moving the device or the piece of winter sports equipment.

The infeed device can have, for example, an electric motor and preferably a transmission gearing in order to drive the infeed device.

The at least one movement device can be formed to move the device for treating a running-surface coating past the piece of winter sports equipment along a longitudinal axis of the piece of winter sports equipment in the course of a first treatment movement and to move the device past the piece of winter sports equipment contrary to the first application movement along the longitudinal axis of the piece of winter sports equipment in the course of a subsequent second treatment movement.

Here, for example, in the course of a first treatment movement, a blower serves as a heating device and is used to melt a ski wax applied to the running-surface coating, wherein in the course of the second treatment movement the temperature of the blower can be lowered in order to serve as a cooling device and to cool the previously applied ski wax to below the solidification temperature of the ski wax.

However, alternatively, the movement device can be formed to execute a continuous treatment movement between piece of winter sports equipment and device. The piece of winter sports equipment with its running-surface coating can be, for example, sequentially moved past the at least one application device, the at least one heating device, the at least one cooling device and optionally the at least one stripping device.

Furthermore, protection is sought for a method for treating a running-surface coating of a piece of winter sports equipment, preferably of a ski or snowboard, including:

- executing a relative movement between the device and the running-surface coating of the winter sports article,
- applying a ski wax to the running-surface coating of the piece of winter sports equipment,
- heating the ski wax applied to the running-surface coating of the piece of winter sports equipment to above the melting temperature of the ski wax and
- actively cooling the heated ski wax to below the solidification temperature of the ski wax.

Preferably, at least 50 pieces of winter sports equipment, preferably 100 pieces of winter sports equipment, particularly preferably 120 pairs of skis are treated per hour.

BRIEF DESCRIPTION OF THE DRAWINGS

Further details and advantages of the present invention are explained in more detail in the following with the aid of the description of the figures with reference to the embodiments represented in the figures, in which.

DETAILED DESCRIPTION OF THE INVENTION

Figure 1:
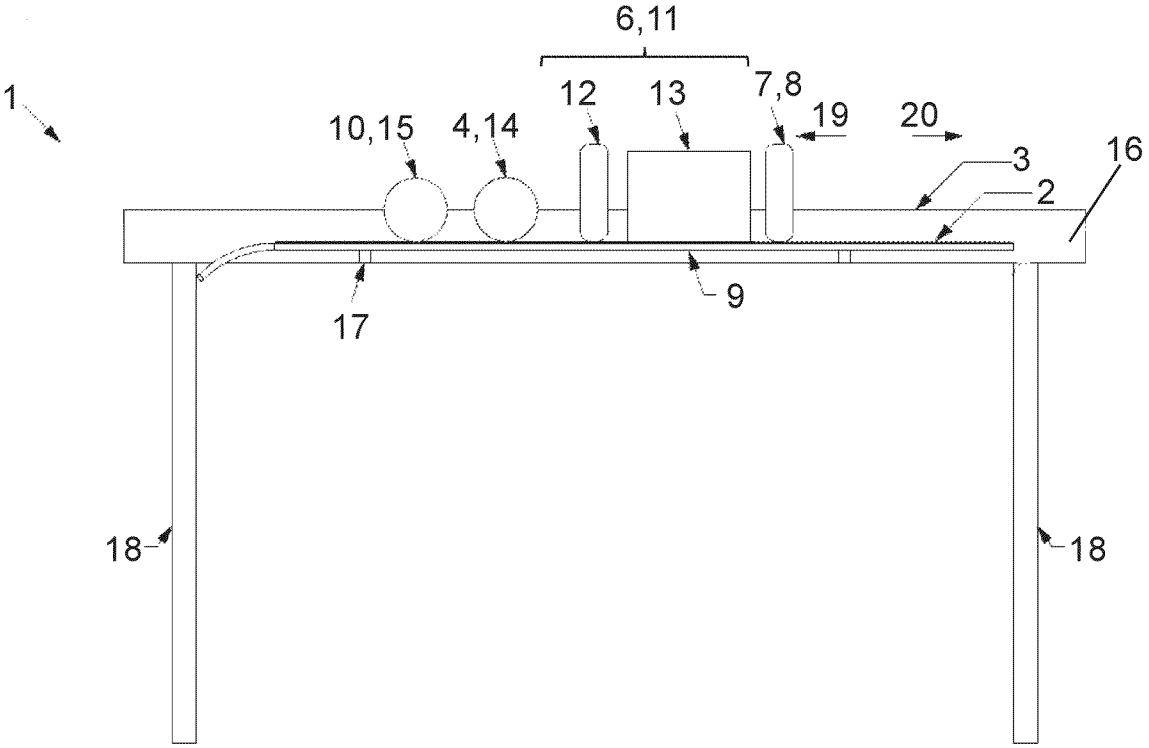
FIG. 1 shows a first embodiment of a device for treating a running-surface coating.

FIG. 1 shows a first embodiment of a device 1 for treating a running-surface coating 3 of a piece of winter sports equipment 2.

In this embodiment shown in FIG. 1, the piece of winter sports equipment 2 is represented as a ski, which is arranged on a holding device 17 of the device 1.

Here, the piece of winter sports equipment 2 is arranged with the running-surface coating 3 upwards, wherein the upper side 9 of the piece of winter sports equipment 2 facing away from the running-surface coating 3 is supported on the holding devices 17.

In this embodiment the piece of winter sports equipment 2 is held stationary via the holding devices 17 and the device 1—more precisely: the receiving plate 16 of the device 1—is moved relative to the piece of winter sports equipment 2 via the movement device.

The movement device is not represented more precisely in this embodiment, wherein a relative movement between the receiving plate 16 of the device 1 and the piece of winter sports equipment 2 can be performed via the movement device.

This relative movement is to be understood as a movement along the longitudinal axis of the piece of winter sports equipment 2 and is indicated by the first movement direction 19 and the second movement direction 20.

The movement device can be formed simply as a guide, wherein an operator can for example execute the relative movement by a hand lever.

However, it can entirely also be provided that the movement device has a drive device, wherein the relative movement between the piece of winter sports equipment 2 and the receiving plate 16 can be controlled or regulated.

After arrangement of the piece of winter sports equipment 2 on the holding devices 17, a movement in a first movement direction 19 can be performed by the device 1—more precisely: the receiving plate 16—whereby the receiving plate 16 moves in a first movement direction 19 parallel to a longitudinal axis of the piece of winter sports equipment 2 over the winter sports equipment 2.

In the course of this a brush roller 15 is first moved over the running-surface coating 3 of the piece of winter sports equipment 2, which brush roller 15 is arranged on the receiving plate 16.

In a first method step, for example an old wax or contaminations on the running-surface coating 3 of the piece of winter sports equipment 2 can be removed by this brush roller 15 and the running-surface coating 3 can be cleaned for the subsequent method.

After that, a ski wax 5 is applied to the running-surface coating 3 of the piece of winter sports equipment 2 via the application device 4, which is also arranged on the receiving plate 16.

This application device 4 is formed in this embodiment as a wax roller 14, which, dispensing ski wax 5, rolls on the running-surface coating 3 of the piece of winter sports equipment 2.

Through this wax roller 14 ski wax 5 in liquid or powder form can for example be distributed—preferably evenly—over the running-surface coating 3 of the piece of winter sports equipment 2.

Then the heating device 6 is guided to the running-surface coating 3 and the ski wax 5 applied thereto.

This heating device 6 is implemented in this embodiment by the two heating stations 11, wherein the first heating station 11 is implemented by a hot air blower 12 and the second heating station 11 is implemented by an IR heater 13.

Ambient air is drawn in and heated by the hot air blower 12, wherein the heated ambient air is then blown onto the ski wax 5 on the running-surface coating 3.

Heat radiation (infrared radiation) is then applied to the ski wax and the running-surface coating 3 via the IR heater 13.

Thus, the applied ski wax 5 on the running-surface coating 3 is heated to above the melting temperature of the ski wax 5 by the heating device 6 and the two heating stations 11, whereby a sufficient crosslinking of the ski wax 5 on the running-surface coating 3 can be carried out.

Through the further relative movement of the device 1—more precisely: the receiving plate 16 with respect to the piece of winter sports equipment 2—the area of the ski wax 5 heated by the heating device 6 and running-surface coating 3 is guided to the cooling device 7.

This cooling device 7 of the embodiment of FIG. 1 is provided as a cool air blower 8.

This cool air blower draws in ambient air and conveys it to the running-surface coating 3 and the ski wax 5 heated here for active cooling, wherein the ski wax 5 is cooled to below the solidification temperature of the ski wax 5.

In addition the cool air blower 8 can have a cooling device, wherein the ambient air which is drawn in by the cool air blower 8 can be cooled before the blowing onto the ski wax 5 on the running-surface coating 3.

When the entire running-surface coating 3 has passed through the device 1—more precisely: has traversed the cooling device 7—the relative movement is reversed into a second movement direction 20, wherein the running-surface coating 3 first comes into contact with the cooling device 7 again and is cooled further once more in a second step.

The heating device 6 is shut down during the movement in this second movement direction 20, wherein an active heating of the running-surface coating 3 is no longer performed while the receiving plate 16 is being passed over the running-surface coating 3 of the piece of winter sports equipment 2 in the second movement direction 20.

In a preferred embodiment it can even be provided that the hot air blower 12 of the heating device 6 is formed so that it can be varied in terms of its temperature, whereby the hot air blower 12 can be optionally switched to a second movement direction 20, whereby only ambient air without heating or optionally even with cooling can be conveyed to the running-surface coating 3 and thus the applied ski wax 5 for further active cooling of the running-surface coating 3.

Furthermore, ski wax 5 is no longer applied to the running-surface coating 3 by the application device 4 in a second movement direction 20, by for example the wax roller 14 being able to be raised from the running-surface coating 3 during execution of the second movement direction 20.

The cooled ski wax 5 on the running-surface coating 3 is then still treated by the stripping device 10, wherein excess ski wax 5 can be removed from the running-surface coating 3 of the piece of winter sports equipment 2.

This stripping device 10 is implemented by the brush roller 15, which thus (in addition to the initial cleaning function) in this embodiment undertakes a double function.

The device 1 of this embodiment can be mounted over the legs 18 and can be raised from a floor or ground, whereby a comfortable working height for an operator can be set.

Unlike what is represented in FIG. 1, the ski tip can also point to the right while passing through.

Figure 2:
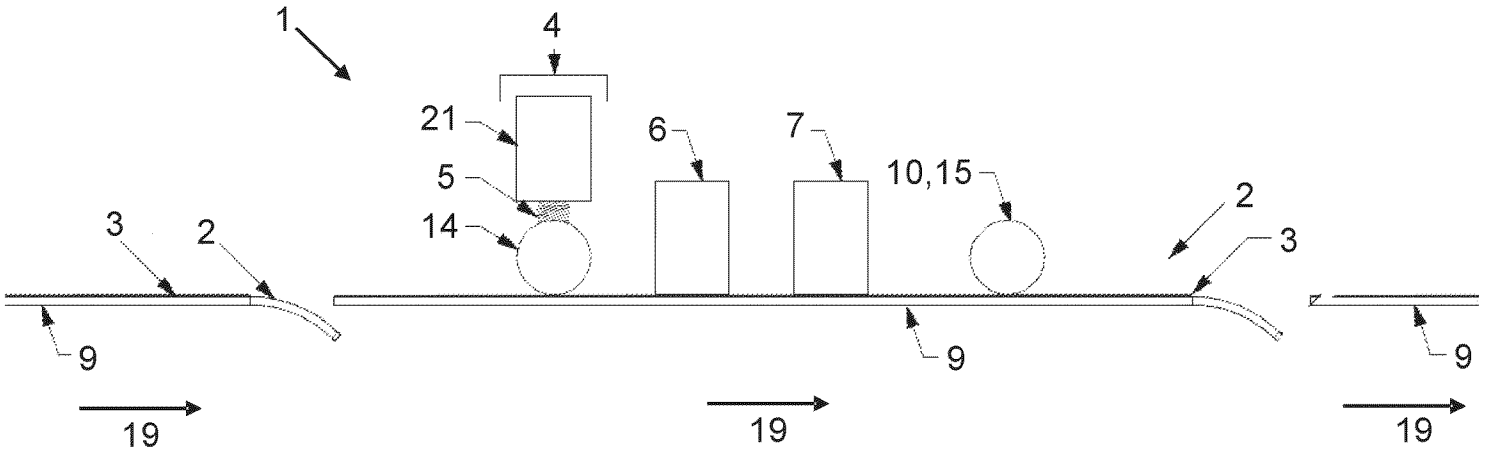
FIG. 2 shows a second embodiment of a device for treating a running-surface coating.

FIG. 2 shows a further embodiment of a device 1 for treating a running-surface coating 3 of a piece of winter sports equipment 2, wherein only a purely schematic representation was chosen here.

Thus, in this embodiment of FIG. 2 the piece of winter sports equipment 2 is continuously moved with only a first movement direction 19 relative to the device 1. Here, the piece of winter sports equipment 3 is in turn arranged with the running-surface coating 3 upwards and the upper surface 9 downwards with respect to the device 1.

Thus, the piece of winter sports equipment 2 first comes into contact with a wax roller 14 of the device 1 with its running-surface coating 3, wherein a powdered or liquid ski wax 5 is applied to the running-surface coating 3 via the wax roller 14.

The application device 4 is formed in this embodiment by the receiving container 21, which applies ski wax 5 to the wax roller 14, and the wax roller 14.

The running-surface coating 3 with the applied ski wax 5 then passes through a heating device 6, wherein the applied ski wax 5 is heated to above a melting temperature of the ski wax 5.

Subsequently, the heated ski wax 5 is in turn actively cooled via a cooling device 7 and the ski wax 5 is brought to below the solidification temperature of the ski wax 5.

Finally, the solidified ski wax 5 is supplied to the running-surface coating 3 of the stripping device 10, which in turn is formed as a brush roller 15, wherein excess ski wax can be removed.

The stripping device 10 can also serve to supply a desired structure to the running-surface coating 3—more precisely: to the ski wax 5 arranged on the running-surface coating 3.

Figure 3:
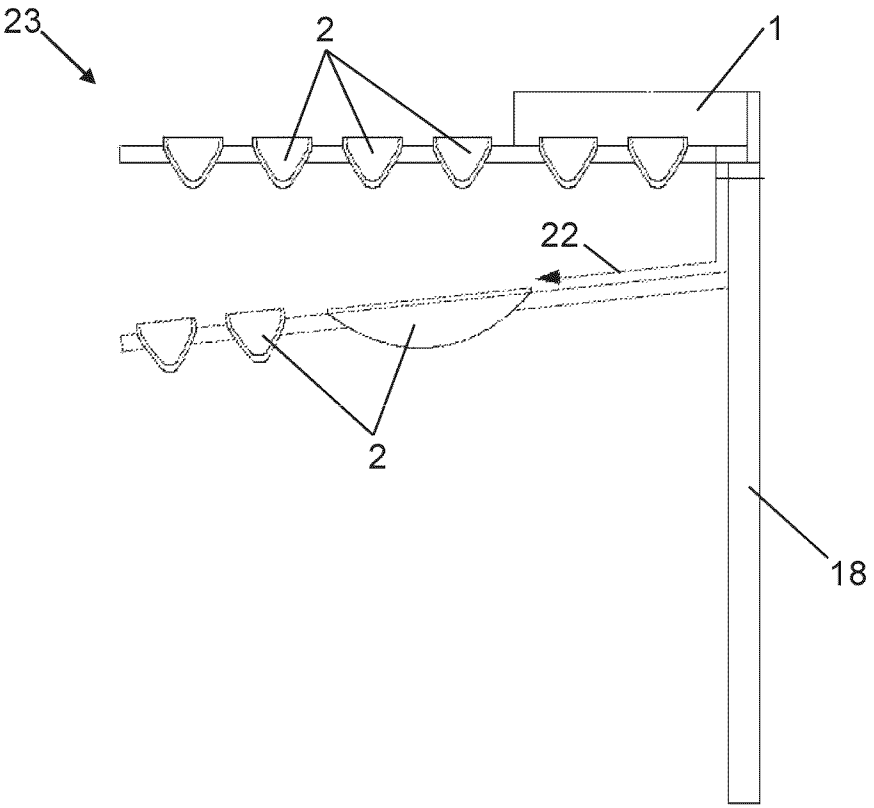
FIG. 3 shows an embodiment of a feeder device of a device for treating a running-surface coating.

FIG. 3 shows an embodiment of a supply device 23 of a device 1 for treating a running-surface coating 3 of a winter sports article 2.

A row of pieces of winter sports equipment 2 can be placed, with the surface side 9, on a first guide rail (an upper guide rail) and are fed in one after another into a treating position of the device 1 for treating the running-surface coating 3.

Two pieces of winter sports equipment 2 can then be treated synchronously by the device 1 for treating the running-surface coating 3 of the piece of winter sports equipment 2.

This device 1 can for example be implemented according to the embodiment of FIG. 1, wherein FIG. 3 could be regarded as a side view of the figure.

After treatment with the device 1 for treating the running-surface coating 3 the pieces of winter sports equipment 2 can be dropped onto the second (the lower) guide rail, wherein this second guide rail represents the device for delivering the piece of winter sports equipment 2 after treatment by the device 1.

This second guide rail is formed sloping, whereby the pieces of winter sports equipment 2, as represented, can slide down due to gravity.

Here, one of the pieces of winter sports equipment previously treated by the device 1 is represented as a snowboard, whereby it is evident that either two skis can be treated by the device 1 or one snowboard, since the device 1 has a corresponding width.

Furthermore, however, loading and unloading devices using paternoster operation or by means of a robot are also entirely conceivable.

Treating capacities of 120 pairs of skis per hour are entirely achievable by the shown device 1 of the embodiments from FIGS. 1-3.

LIST OF REFERENCE NUMBERS

1 device for treating a running-surface coating
2 piece of winter sports equipment
3 running-surface coating
4 application device
5 ski wax
6 heating device
7 cooling device
8 cool air blower
9 upper side
10 stripping device
11 heating station
12 hot air blower
13 IR heater
14 wax roller
15 brush roller
16 receiving plate
17 holding device
18 leg
19 first movement direction
20 second movement direction
21 receiving container
22 movement direction
23 supply device

The invention claimed is:

1. A device for treating a running-surface coating of a piece of winter sports equipment, the device comprising:

at least one movement device for generating a relative movement between the device and the running-surface coating of the piece of winter sports equipment;

at least one application device for applying a ski wax to the running-surface coating of the piece of winter sports equipment;

at least one heating device for heating the ski wax applied to the running-surface coating of the piece of winter sports equipment to above a melting temperature of the ski wax; and at least one cooling device for actively cooling the ski wax melted by the at least one heating device to below a solidification temperature of the ski wax, wherein:

the at least one cooling device has at least one cool air blower for blowing a gaseous fluid to cool the ski wax melted by the at least one heating device; and the at least one cool air blower has a cooling apparatus for lowering a temperature of the gaseous fluid.

2. The device according to claim 1, further comprising at least one stripping device for removing an excess solidified amount of the ski wax from the running-surface coating of the piece of winter sports equipment.

3. The device according to claim 1, wherein the at least one heating device has at least two heating stations.

4. The device according to claim 1, wherein the at least one heating device has at least one hot air blower, infrared heater or ironing device.

5. The device according to claim 1, wherein the at least one application device can apply the ski wax in a powder state or a liquid state.

6. The device according to claim 1, wherein the ski wax comprises a hydrocarbon wax or a fluoro wax.

7. The device according to claim 1, wherein the at least one movement device has a controlled infeed device or a regulated infeed device.

8. The device according to claim 1, wherein the at least one movement device is configured to: (i) move the device past the piece of winter sports equipment along a longitudinal axis of the piece of winter sports equipment in a first treatment movement; and (ii) move the device past the piece of winter sports equipment opposite to the first treatment movement along the longitudinal axis of the piece of winter sports equipment in a second treatment movement subsequent to the first treatment movement.

9. A method for treating a running-surface coating of a piece of winter sports equipment, with the device according to claim 1, the method comprising:

executing the relative movement between device and the running-surface coating of the piece of winter sports equipment;

applying the ski wax to the running-surface coating of the piece of winter sports equipment;

heating the ski wax applied to the running-surface coating of the piece of winter sports equipment to above the melting temperature of the ski wax; and actively cooling the heated ski wax to below the solidification temperature of the ski wax.

10. The method according to claim 9, wherein at least fifty pieces of winter sports equipment are treated per hour.

11. A device for treating a running-surface coating of a piece of winter sports equipment, the device comprising:

at least one movement device for generating a relative movement between the device and the running-surface coating of the piece of winter sports equipment;

at least one application device for applying a ski wax to the running-surface coating of the piece of winter sports equipment;

at least one heating device for heating the ski wax applied to the running-surface coating of the piece of winter sports equipment to above a melting temperature of the ski wax; and at least one cooling device for actively cooling the ski wax melted by the at least one heating device to below a solidification temperature of the ski wax, wherein the at least one cooling device has a cooled section, which can be brought into contact with the piece of winter sports equipment.

12. The device according to claim 11, further comprising a blower configured to operate selectively as the at least one heating device and the at least one cooling device due to an adjustable temperature of a released gaseous fluid.

13. The device according to claim 11, further comprising at least one stripping device for removing an excess solidified amount of the ski wax from the running-surface coating of the piece of winter sports equipment.

14. The device according to claim 11, wherein the at least one heating device has at least two heating stations.

15. The device according to claim 11, wherein the at least one heating device has at least one hot air blower, infrared heater or ironing device.

16. The device according to claim 11, wherein the at least one application device can apply the ski wax in a powder state or a liquid state.

17. The device according to claim 11, wherein the at least one movement device has a controlled infeed device or a regulated infeed device.

18. The device according to claim 11, wherein the at least one movement device is configured to: (i) move the device past the piece of winter sports equipment along a longitudinal axis of the piece of winter sports equipment in a first treatment movement; and (ii) move the device past the piece of winter sports equipment opposite to the first treatment movement along the longitudinal axis of the piece of winter sports equipment in a second treatment movement subsequent to the first treatment movement.

19. A method for treating a running-surface coating of a piece of winter sports equipment, with the device according to claim 11, the method comprising:

executing the relative movement between the device and the running-surface coating of the piece of winter sports equipment;

applying the ski wax to the running-surface coating of the piece of winter sports equipment;

heating the ski wax applied to the running-surface coating of the piece of winter sports equipment to above the melting temperature of the ski wax; and actively cooling the heated ski wax to below the solidification temperature of the ski wax.

20. The method according to claim 19, wherein at least fifty pieces of winter sports equipment are treated per hour.

* * * * *